United States Patent [19]

Jeng

[11] 4,233,003

[45] Nov. 11, 1980

[54] ROTARY PUMP

[76] Inventor: Wang-Shing Jeng, 6-1, Alley 27, La. 278, Yung Chi Rd., Taipei, Taiwan

[21] Appl. No.: 949,894

[22] Filed: Oct. 10, 1978

[51] Int. Cl.[3] ..... F04C 18/02; F04C 23/00; F04C 29/08

[52] U.S. Cl. ..... 418/8; 418/15; 418/61 B; 418/185; 418/186

[58] Field of Search ..... 418/8, 15, 54, 61 B, 418/185–188

[56] References Cited

U.S. PATENT DOCUMENTS

| | | | |
|---|---|---|---|
| 2,468,373 | 4/1949 | Makaroff | 418/8 |
| 3,301,228 | 1/1967 | Winans | 418/61 B |
| 3,340,853 | 9/1967 | Link | 418/61 B |

FOREIGN PATENT DOCUMENTS

| | | | |
|---|---|---|---|
| 1261674 | 4/1961 | France | 418/185 |
| 176112 | 2/1922 | United Kingdom | 418/61 B |

*Primary Examiner*—John J. Vrablik
*Attorney, Agent, or Firm*—J. Harold Nissen

[57] ABSTRACT

A rotary pump which comprises a cylinder having two walls which cover both ends thereof to form a compressing chamber, each of the walls includes a bearing at its center and holes around the bearing to form an inlet or an outlet of the fluid, a shaft supported by the bearings and driven by a motor, a piston having two connected arc surfaces rotatably mounted within the cylinder, each surface of the piston including a groove, an outlet port and an inlet port, a separating plate mounted in the hole of the piston and dividing the hole into two parts and separating the outlet ports and inlet ports on each part, a plunger which may be moved back and forth in the piston hole to open or close the inlet ports. The present invention can pump the fluid in periodic high pressure or stable middle pressure by controlling the movement of the plunger in piston.

8 Claims, 5 Drawing Figures

ROTARY PUMP

BACKGROUND OF THE INVENTION

The conventional pumps such as centrifugal pumps have a rotary impeller driven by a motor. The blades of the impeller in revolving produce a reduction in pressure at the entrance or eye of the impeller. This causes liquid to flow into the impeller from the suction pipe. This liquid is forced outward along the impeller blades at an increasing velocity. Another kind is a gear pump, which includes two or more impellers in a rotary-pump casing, the impeller will take the form of toothed-gear wheels. As the spaces between the teeth of the impeller pass the suction opening, liquid is impounded between them, carried around the casing to the discharge opening, and then forced out through this opening. These conventional pumps only provide a fixed pump effect, and their pump condition is unchangable.

The present invention thus relates to an improved pump, more particularly, to a novel rotary pump which may produce two kinds of pump effects and avoid the disadvantages of the prior art.

An object of the present invention is to apply the main structure of the rotary piston engines to pump to gain a high efficiency implement.

It is another object of the present invention to provide a pump which may simply adjust the position of a plunger to produce two kinds of pump effects i.e. a periodic high pressure and a stable middle pressure of exhausting fluid.

These and other objects and features of this invention will be better understood and appreciated from the following detailed description of a prefered embodiment thereof in the accompanying drawings.

DETAILED DESCRIPTION OF THE INVENTION

Figure 1:
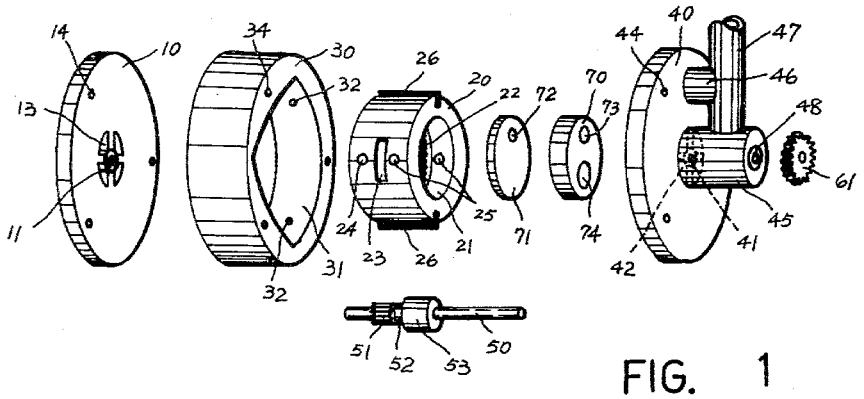
FIG. 1 is a perspective view of all components of the rotary pump according to the present invention.
Figure 2:
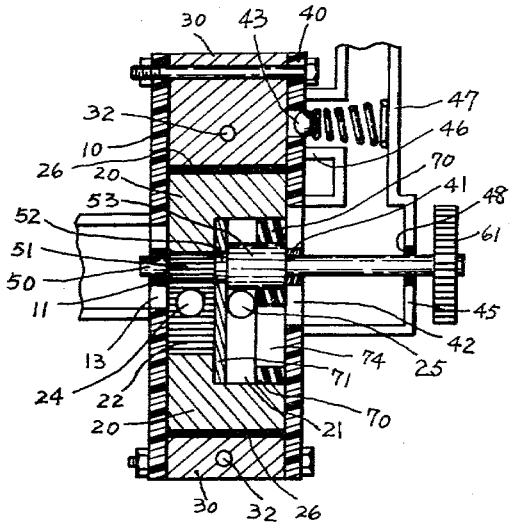
FIG. 2 is a sectional view of the rotary pump according to the present invention.
Figure 5:
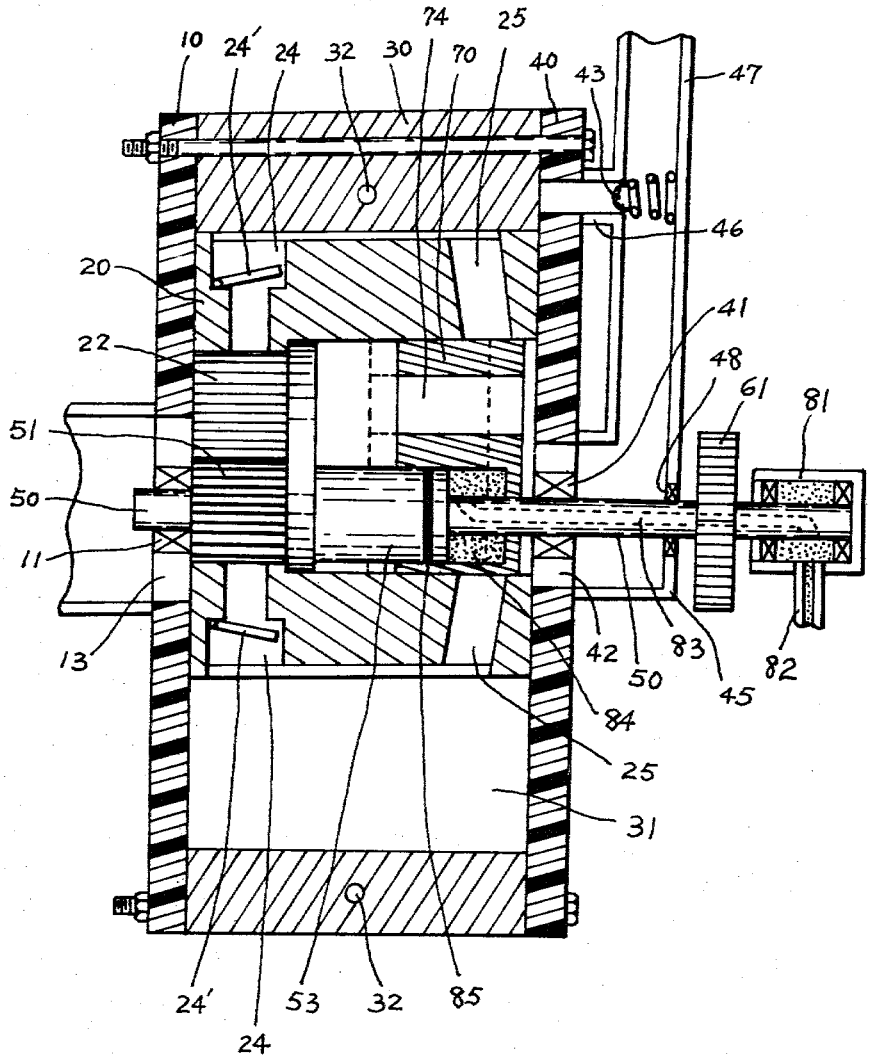
FIG. 5. is a sectional view similar to FIG. 2 illustrating the check valves and controls.

As shown in FIGS. 1, 2 and 5, the rotary pump of the present invention mainly comprises a cylinder 30 two fluid channels generally designated 32, a front wall 10, a rear wall 40, a piston 20, a shaft 50, a separating plate 71 and a plunger 70.

Figure 3:
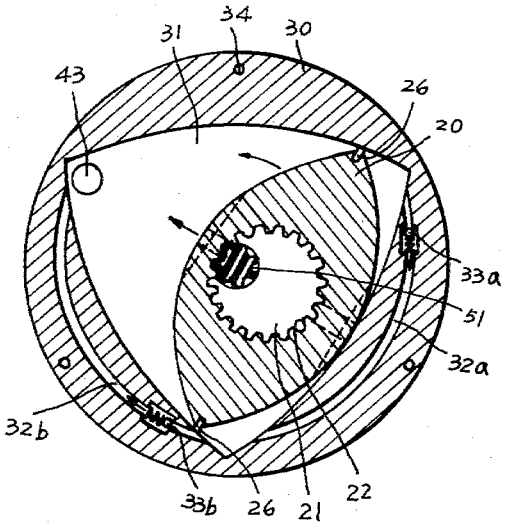
FIG. 3 is a front view of the rotary pump in FIG. 2 with the front wall thereof removed.

The cylinder 30 has three connected inner walls of hypotrochoid to form a triangular compression or compressing chamber 31. As shown in FIG. 3, two fluid channels 32*a* and 32*b*, and generally designated 32 extend into the two inner walls of the cylinder 30. Both ends of each fluid channels 32*a*, 32*b* are adjacent to both ends of each inner wall. Moreover, the right ends of the fluid channels 32*a*, 32*b* are controlled by check valves 33*a*, 33*b* to admit the fluid only which flows from right to left in the channels 32.

The check valves 24' in the inlet ports 24 of the piston 20 are more clearly shown in FIG. 5 of the drawing, which only lets fluid to flow into compressing chamber

31 from the front section of the piston hole 21 and stops fluid to return back.

Both the front wall 10 and the rear wall 40 are fastened on both ends of the cylinder 30 by fasteners through the corresponding screw holes 14, 34, 44 on front wall 10, cylinder 30 and rear wall 40. Two bearings 11, 41 are secured at the centers of the walls 10, 40 respectively. Around the bearings 11, 41, there are fluid inlet 13 on the front wall 10 and outlet 42 on the rear wall 40. The fluid outlet 42 connects with an exhausting pipe 45 of middle pressed fluid. Beside the pipe 45, the rear wall 40 also connects with another exhausting pipe 46 of high pressed fluid. Said exhausting pipe 46 of high pressed fluid includes a check valve 43 to prevent the exhausted fluid from flowing back into the pump.

The shaft 50 is supported by the two bearings 11, 41 on the centers of front wall 10 and rear wall 40 respectively. The rear end of the shaft 50 extends out of the exhausting pipe 45 and connects directly or indrectly with a motor. That is to say the shaft 50 is driven by the motor. A seal ring 48 is secured between the rear end of the exhausting pipe 45 and the shaft 50 to avoid any fluid leaking out of the pipe 45. The shaft 50 between the front wall 10 and rear wall 40 includes three sections. The front section is a gear 51 contacting piston gear 22 for driving the piston 20. The middle section 52 and the rear section 53 are smooth rod, and the middle section 52 has a diameter as same as the gear 51, but the rear section 53 has an enlarged diameter.

The piston 20 is rotatably mounted in the compressing chamber 31 and is driven by the shaft 50. The outer wall consists of two connected arc surfaces. Two sealing grids 26 are secured on the two ends of the piston 20. At the middle portion of each arc surface, there is a groove 23 and two ports 24, 25. The two inlet ports 24 on the two arc surfaces are in front of the grooves 23 and the outlet ports are in rear of the grooves 23. Each of the ports includes a check valve for controlling fluid flow. The center of the piston 20 is an interior hole 21 which includes two sections, a front section and a rear section. The front section is a piston gear 22 contacting the shaft gear 51, the rear section 27 has an enlarged diameter and the surface thereof is smooth.

A seperating plate 71 having a shaft hole 72 corresponding to the middle section 52 of the shaft 50 is rotatably mounted in the piston hole 21. A plunger 70 having a shaft hole 73 and a fluid passage 74 is also inserted into the piston hole 21. The shaft hole 73 of the plunger 70 is corresponding to the rear section 53 of the shaft 50. When the components are installed in the compressing chamber, the shaft 50 perforates through the piston 20, separating plate 71 and the plunger 70 in the manner of the shaft gear 51 contacts the piston gear 22 for driving the piston 20, the middle section 52 of the shaft 50 is inserted into the shaft hole 72 of the separating plate 71, and the rear section 53 of the shaft 50 is inserted into the shaft hole 73 of the plunger 70. Both of the boundaries of the separating plate 71 and the plunger 73 closely contact the inner surface of the rear section 27 of the piston 20. The separating plate 71 is limited between the front section 22 of the piston 20 and rear section 53 of the shaft 50 and separates the piston hole 21 into two rooms, one connects with inlet ports 24, another connects with outlet ports 25. The plunger 70 has a thickness slightly larger than the diameter of the outlet ports 25, so when the plunger 70 is moved back and forth by control means, the outlet ports are opened or closed by the plunger 70.

An important feature of the check valves used in the present pump is that the valves having different pressure against fluid i.e. the check valve 43 in exhausting pipe 46 has hightest pressure against fluid, the second is the check valve 33*b* in fluid channel 32*b* (as shown in FIG. 3), the third is the check valve 33*a* in channel 32*a*, the weakest is the check valves in the inlet and outlet ports 24, 25 on the piston 20.

Another feature is that the inlet 13 on the front wall 10 should be covered by one side of the piston 20 when rotation, and part of the inlet 13 connects with the piston hole 21. Therefore, the fluid passes the inlet 13 and flows into the piston hole 21 completly.

There is still another feature, the fluid passage 74 on plunger 70 connects with the outlet 42 on rear wall 40 to admit the fluid flows out of the piston 20.

Figure 4:
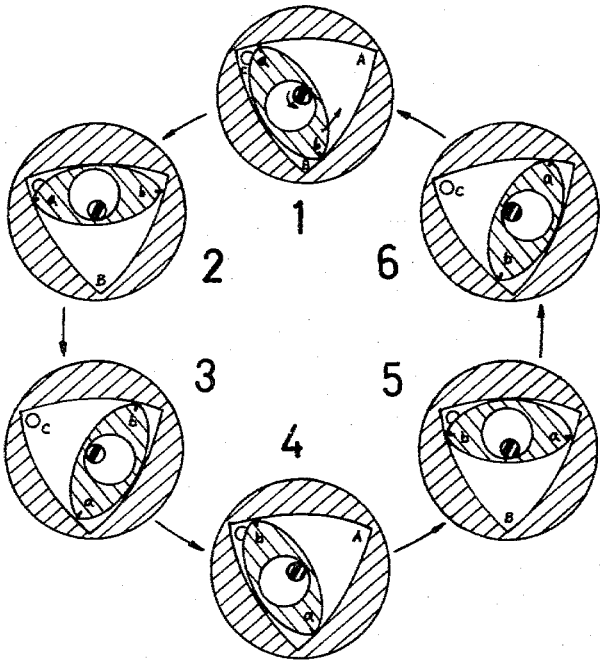
FIG. 4 illustrates the pumping process of the rotary pump in FIG. 3.

FIG. 4 represents the process of movement of the piston while pumping fluid by using present invention. When the shaft 50 is driven counter-clockwise, the piston 20 turns in same direction. Suppose the plunger 70 in the piston 20 is in the position of closing the outlet ports 25. The fluid flows into the front section of the piston hole 21 through the inlet 13 on front wall 10. Due to the piston 20 is driven in high speed rotation and the volume of space between the piston 20 and the cylinder 30 is changed, so that the centrifugal force and the suction force cause the fluid projecting into the compressing chamber 31 through the inlet ports 24 on piston 20 (as shown by the arrow in FIG. 3). The piston rotates continously and presses the fluid in the chamber 31. The fluid exhausted from the piston hole 21 can never flow back, because the inlet ports 24 are controlled by check valves (non-return valves) and the outlet ports 25 are closed by the plunger 70. When the piston 20 moves from stage 1 to stage 2 (as shown in FIG. 4), the fluid in room A is pressed to room B through the channel 32*a* and the check valve 33*a*, meanwhile additional fluid is projected into room B through inlet port 24, therefore more fluid is contained in room B. When the piston 20 moves from stage 2 to 3, the fluid in chamber B is pressed to room C through the channel 32*b* and the check valve 33*b*. Besides, more fluid is projected into room C through inlet port 24, so that more and more fluid is sucked into the compressing chamber 31 and compressed therein. While between stages 3 and 4, as soon as the pressure of highly compressed fluid excesses the pressure of check valve 43 on rear wall 40, the fluid suddenly opens the valve 43 and flows into the exhausting pipe 46 and combined exhausting pipe 47. The stages 4, 5 and 6 of next half cycle repeats the similar process. While the piston 20 is rotating fluid also transfers from one room to another room through the grooves 23 on the surface of the piston 20. For example, between stage 1 to stage 2, the fluid in room C flows to room B through groove 23. This makes the piston 20 rotates more smoothly. From the foregoing description, it is obviously that the fluid is pumped by the present pump in the manner of periodic high pressure.

The above-mentioned pumping condition can also be adjusted to be a stable middle pressure. This may be accomplished by moving the plunger 70 to rear position i.e. open the outlet ports 25 for admitting the compressed fluid in compressing chamber 31 flowing into the rear section 27 of the rotary piston 20 and then being pressed into the exhausting pipe 45 through the fluid passage 74 on the plunger 70 and the outlet 42 on the rear wall 40, then into the combined exhausting pipe 47. By using this process a stable middle exhausted fluid pressure is gained.

Several methods may be used to move the plunger along the rear section of the pistion hole, for example, by using electric magnetic force, oil pressure or other automatic process.

Specifically, in order to provide for the movement of plunger 70, a control means is provided.

The function of the control means is to control the motion of the plunger 70, i.e. to move the plunger 70 back and forth. For accomplishment of this function, reference is made to FIG. 5 which illustrates that the plunger 70 may be improved to have an oil chamber 84 to work as a cylinder and the rear section 53 of the shaft 50 works as a piston which has an oil seal ring 85 mounted on its surface. One end of the shaft 50 has an oil container 81 and has a connector 82 to connect with a compressor and a pump. An electromagnetic valve is used to control the connection of the connector 82 only with the compressor or the pump. The shaft 50 has an oil channel 83 to connect the oil container 81 and the oil chamber 84.

When the connector 82 connects with the compressor, the oil in the oil container 81 is pressed and flows into oil chamber 84 through the oil channel 83. In this condition, the oil chamber 84 needs more space to contain the increasing oil, so that the plunger 70 is moved rightward. When the connector 82 connects with the pump, the oil in the oil chamber 84 is sucked and flows back to the oil container 81 through the oil channel 83. The volume of the oil in oil chamber 84 is reduced and the plunger 70 is moved leftward.

By using this structure, it is possible simply to control the electromagnetic valve with electric signal to select the condition of pressing or sucking oil.

Having described this invention in detail, those skilled in the art will appreciate that numerous modification may be made therein without departing from the scope and spirit of this invention. Therefore, it is not intended that the breadth of this invention be limited to the specific embodiment illustrated and described. Rather, it is intended that the scope of this invention be determined by the appended claims.

I claim:

1. A rotary pump comprising:

a cylinder having three connected inner walls, and two channels extending in two of said walls, each said channel having a check valve at a similar end;

a front wall fastened on the front side of said cylinder having a bearing at its center and a fluid inlet surrounding said bearing;

a rear wall fastened on the rear side of said cylinder having a bearing at its center and a fluid outlet surrounding said bearing, said outlet being connected with an exhausting pipe and another exhausting pipe connecting with a check valve on said rear wall;

a piston rotatably mounted in said cylinder having two arc surfaces and a circular internal hole, each said surface including a groove at its center and an outlet port and an inlet port located on both sides of the groove, and both of said ports having check valves therein, said internal hole having a gear section and an enlarged section having a smooth surface;

a shaft supported by said two bearings on said front and rear walls, said shaft including three sections, a front section having a gear, a middle section of circular rod having a smooth surface and a diameter similar to the gear section, and an enlarged rear section having a smooth surface;

a separating plate closely rotatably mounted in the rear section of said piston hole and having a shaft hole corresponding to the middle section of said shaft;

a plunger closely rotatably mounted in the rear section of said piston hole having a fluid passage and a shaft hole corresponding to the rear section of said shaft, and having a thickness of slightly larger than the diameter of the outlet ports on said piston.

2. A rotary pump as claimed in claim 1 wherein the check valve on said rear wall is biased with greater pressure than the check valves at the ends of the channels in said cylinder, and said check valves in said cylinder are biased with greater pressure than the check valves in the outlet and inlet ports on said pistons.

3. A rotary pump as claimed in claim 1 wherein the inner side of the inlet on said front wall is completly covered by said piston and said inlet connects with the internal hole of said piston.

4. A rotary pump as claimed in claim 1 wherein the outlet on said rear wall connects with the fluid passage on said plunger.

5. A rotary pump as claimed in claim 1 wherein said separating plate separates the piston hole into two sections, a gear section connecting with said inlet ports and an enlarged section connecting with said outlet ports.

6. A rotary pump as claimed in claim 1 wherein said plunger is moved back and forth by a control means.

7. A rotary pump as claimed in claim 1 or 6, wherein said outlet ports on the piston are closed by said plunger when said plunger is moved forward and said outlet ports are opened by said plunger when said plunger is moved back.

8. A rotary pump as claimed in claim 1 wherein said shaft connects with a motor directly or indirectly and the gear section of said shaft contacts the gear section in said piston hole.

* * * * *